US006687481B2

(12) United States Patent
Watanabe et al.

(10) Patent No.: US 6,687,481 B2
(45) Date of Patent: Feb. 3, 2004

(54) INDUCTIVE THERMAL FIXING APPARATUS HAVING MAGNETIC FLUX BLOCKING PLATE WITH SPECIFIC THICKNESS

(75) Inventors: Osamu Watanabe, Yokohama (JP); Nobuaki Hara, Abiko (JP); Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/155,182

(22) Filed: May 28, 2002

(65) Prior Publication Data

US 2002/0186991 A1 Dec. 12, 2002

(30) Foreign Application Priority Data

May 28, 2001 (JP) ..... 2001-158641

(51) Int. Cl.[7] ..... G03G 15/20

(52) U.S. Cl. ..... 399/328; 174/35 CE; 219/619; 361/816; 399/45; 399/69; 399/334

(58) Field of Search ..... 399/328, 330, 399/334, 67, 45; 219/216, 619, 469; 174/35 R, 35 CE; 361/816

(56) References Cited

U.S. PATENT DOCUMENTS

| | | | | |
|---|---|---|---|---|
| 6,055,403 A | | 4/2000 | Watanabe | 399/328 |
| 6,175,713 B1 | * | 1/2001 | Uehara et al. | 219/619 X |
| 6,198,901 B1 | | 3/2001 | Watanabe | 399/328 |
| 6,377,775 B1 | | 4/2002 | Nakayama et al. | 399/328 |
| 6,400,924 B1 | | 6/2002 | Watanabe | 399/333 |
| 6,405,014 B2 | * | 6/2002 | Takano et al. | 399/330 |
| 6,414,500 B1 | * | 7/2002 | Mizuta | 324/754 |
| 6,453,144 B1 | * | 9/2002 | Sato | 399/328 |
| 6,483,088 B2 | * | 11/2002 | Uehara et al. | 219/619 |
| 6,507,008 B2 | * | 1/2003 | Nakayama et al. | 219/619 |
| 2002/0141794 A1 | * | 10/2002 | Hirst et al. | 399/328 |

FOREIGN PATENT DOCUMENTS

| | | | |
|---|---|---|---|
| JP | 9-171889 | | 6/1997 |
| JP | 10-74009 | | 3/1998 |
| JP | 2001-005315 | * | 1/2001 |

* cited by examiner

*Primary Examiner*—Sophia S. Chen
(74) *Attorney, Agent, or Firm*—Fitzpatrick, Cella, Harper & Scinto

(57) ABSTRACT

An image fixing apparatus has a magnetic field generating unit for generating a magnetic flux; a heating member generating heat by induction heating by the magnetic flux generated by the magnetic field generating unit; and a blocking plate, disposed for movement between the magnetic field generating unit and the heating member, for blocking the magnetic flux from the magnetic field generating means, wherein the blocking plate comprises an electroconductive member having a thickness of 0.1–2 mm.

6 Claims, 4 Drawing Sheets

INDUCTIVE THERMAL FIXING APPARATUS HAVING MAGNETIC FLUX BLOCKING PLATE WITH SPECIFIC THICKNESS

FIELD OF THE INVENTION AND RELATED ART

The present invention relates to a fixing apparatus which is for thermally fixing an image on recording medium, and is used for an image forming apparatus, such as a copying machine, a printer, or the like, which employs an electrophotographic recording method, an electrostatic recording method, or the like.

An electrophotographic copying machine or the like is provided with a heating apparatus, which is for fusing a toner image (unfixed image) on a recording medium to the recording medium, by thermally melting the toner (developer) of the toner image while the recording medium, which is bearing the unfixed toner image, is being conveyed.

There are various heating apparatuses, most of which are provided with a fixing roller as a heating medium. It is known that various attempts have been made in order to quickly increase the temperature of the fixing roller. For example, the fixing roller has been reduced in diameter; the wall of the fixing roller has been reduced in thickness; and/or a heating medium placed in the hollow of a rotational cylinder of film has been pressed against the recording medium, through the rotational cylinder of film. Further, in some fixing apparatuses, a thin metallic rotational member is heated by induction. In spite of the difference in approach, the gist of all the attempts has been to reduce the thermal capacity of the rotational member, that is, the heating medium, in order to heat the recording medium with the use of a heat source which is superior in heating efficiency.

Further, there are a few fixing apparatuses which employ a noncontact heat source. However, in consideration of cost and energy efficiency, more contact heating apparatuses have been proposed as a heating apparatus for an image forming apparatus such as a copying machine. In the case of a contact heating apparatus, a rotational member with a thin wall is placed in contact with a recording medium to heat the developer on the recording medium in order to thermally melt the developer.

However, a contact heating apparatus such as the one described above suffers from the following problems: a rotational member with a thin wall employed as a heating medium in order to reduce the thermal capacity of the heating medium is very small in the sectional area, perpendicular to the axial direction of the heating medium, being therefore inferior in the thermal conduction in the direction parallel to the axial direction of the heating medium; the thinner the wall of the heating medium, the worse the above described thermal conduction. Further, the usage of a resinous material, which generally is low in thermal conduction, as the material for the rotational member with a thin wall, makes worse the thermal conduction of the rotational member in the direction parallel to the axial direction of the rotational member.

This is evident from Fourier law of heat conduction, which shows the amount (Q) of heat conducted per unit of time between given two points:

$$Q=\lambda\cdot f(\theta 1-\theta 2)/L$$

$\lambda$: thermal conductivity or conduction $\theta 1-\theta 2$: temperature difference between two points L: length This means that there will be no problem when a recording medium, the dimension of which in terms of the direction parallel to the lengthwise direction of the rotational member, or the heating medium, is the same as the length of the rotational member, is passed through the fixing apparatus for fixation, but that when a plurality of recording mediums, the dimension of which in terms of the direction parallel to the lengthwise direction of the rotational member, is less than the length of the rotational member, are passed in succession, there will be a problem in that the temperature or the portion of the rotational member outside the recording medium path will become higher then the specific value to which the temperature of the rotational member is set for image fixation; in other words, the temperature difference between the portion of the rotational member outside the recording medium path and the portion of the rotational member inside the recording medium path, will become extremely large.

It is possible that this problem, that is, the nonuniformity of the temperature of the heating medium in terms of the lengthwise direction of the heating medium, will reduce the durability of the components in the adjacencies of the heating medium, which are formed of resinous material, and/or will damage the components. Further, it is also possible that this problem will cause a problem that when a recording medium with a larger size is passed through a fixing apparatus structured as described above immediately after a substantial number of recording mediums with a smaller size are passed. The nonuniformity of the temperature of the heating medium in its lengthwise direction will wrinkle and/or skew the larger recording medium, and/or will result in the nonuniform fixation of the image on the larger recording medium.

The higher the throughput (number of prints produced per unit of time), the greater the amount of the temperature difference between the portion of the heating medium outside the recording medium path and the portion of the heating medium inside the recording medium path. This makes it difficult to use a heating apparatus, the heating medium of which is a rotational member with a thin wall and a low thermal capacity, as the fixing apparatus for a copying machine or the like, the throughput of which is relatively high.

There have also been known various heating apparatuses in which a halogen lamp or a heat generating resistor is used as a heat source. Among some of these heating apparatuses, the heat source is divided into a certain number of sections which can be independently activated so that electrical power can be supplied to virtually only the sections of the heat source, the positions of which correspond to the path of the recording medium being passed.

Further, there have been known heating apparatuses, the heat source of which comprises a plurality of discrete induction coils, which can be selectively supplied with electrical power.

However, the provision of a plurality of heat sources, or the division of a heat source into a plurality of sections creates a problem; the greater the number of heat sources or heat source sections, the more complicated the control circuit, and therefore, the more costly. In addition, if an attempt is made to match the number of heat sources, or the number of the sections into which a heat source is divided, with the width of the recording medium path, which varies depending on the recording medium in use, the number of heat sources, or the number of sections into which a heat source is divided, increases, increasing thereby apparatus cost. Further, where a rotational member with a thin wall, which has a given number of sections, is used as a heating medium, it is possible that the temperature distribution across the borders between the adjacent two sections will become discontinuous and nonuniform, affecting the fixing performance.

Thus, various proposals have been made as the solutions to the above described problems. According to some of the proposals, a heating medium is provided with a magnetic flux blocking means, and a moving means for changing the position of the magnetic flux blocking means. The magnetic flux blocking means is for partially blocking the magnetic flux, which is radiated from a magnetic field generating source toward a heating medium. For example, according to the inventions disclosed in Japanese Laid-open patent Applications 9-17889 and 10-74009, a magnetic flux blocking means, and a means for moving the magnetic flux blocking means, are provided to block the magnetic flux from the magnetic flux radiating source, except for the portion of the magnetic flux which is destined to reach the portion of the heating medium necessary to be heated; in other words, the heat distribution of the heating medium is controlled by generating heat only in the portion of the heating medium necessary to be heated for the fixation of an image on the recording medium being passed through the heating apparatus.

In order to prevent the temperature of the magnetic flux blocking plate itself from rising, the material for a magnetic flux blocking plate is desired to be such a nonmagnetic material as copper, aluminum, silver or silver alloy, or the like, which is electrically conductive so that inductive current is allowed to flow through the magnetic flux blocking plate, and also is small in specific resistance. Also, ferrite or the like, which is capable of confining magnetic flux, but is relatively high in specific resistance, is desirable as the material for a magnetic flux blocking plate. Further, magnetic material such as iron or nickel can be used as the material for the magnetic flux blocking plate, with the condition that a magnetic flux blocking plate is to be provided with through holes in the form of a circle or a slit to minimize the heat generation by eddy current.

However, in the case of the heating apparatuses according to the prior arts, the magnetic flux blocking plate is placed close to the heating medium, and therefore, they have the following flaws:

Generally, metals such as copper, silver, aluminum, or the like, are high in electrical conductivity. Thus, if the magnetic flux blocking plate is formed of copper, silver, aluminum, or the like, the amount by which heat is conducted to the magnetic flux blocking plate from the heating medium increases in proportion to the thermal capacity of the magnetic flux blocking plate, reducing thereby the rate at which the temperature of the heating medium increases. On the contrary, if the thickness of the magnetic flux blocking plate is extremely reduced to reduce the thermal capacity of the magnetic flux blocking plate, not only does the magnetic flux blocking plate fail to completely block the magnetic flux, but also heat is generated in the magnetic flux blocking plate itself due to the concentration of the magnetic flux, increasing the temperature in the adjacencies of the inductive heat generating source, which in turn destroys the insulating property of the insulating layer which covers the coil, that is, the inductive heat generating source.

When a magnetic flux blocking plate is disposed close to a cylindrical heating medium, it must be made arcuate. However, the magnetic material such as ferrite which has a large specific resistance is generally interior in formability, making it difficult to form an arcuate magnetic flux blocking plate using such magnetic material.

It is possible to form a magnetic flux blocking plate using magnetic substance such as iron, nickel, or the like, and to provide the magnetic flux blocking plate with round holes and/or slits to minimize the effects of the heat generated therein. In such a case, however, the magnetic flux reaches the heating medium, although by only a small amount, generating heat in the portion of the heating medium outside the recording medium path, creating waste in terms of energy consumption.

SUMMARY OF THE INVENTION

The primary object of the present invention is to provide a fixing apparatus capable of preventing the temperature of the portion of its heating medium outside the recording medium path from rising.

Another object of the present invention is to provide a fixing apparatus shorter in the startup time than a fixing apparatus in accordance with the prior arts.

According to an aspect of the present invention, there is provided an image fixing apparatus comprising:

magnetic field generating means for generating a magnetic flux;

a heating member generating heat by induction heating by the magnetic flux generated by said magnetic field generating means; and a blocking plate, disposed for movement between said magnetic field generating means and said heating member, for blocking the magnetic flux from said magnetic field generating means, wherein said blocking plate comprises an electroconductive member having a thickness of 0.1–2 mm.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

Figure 1:
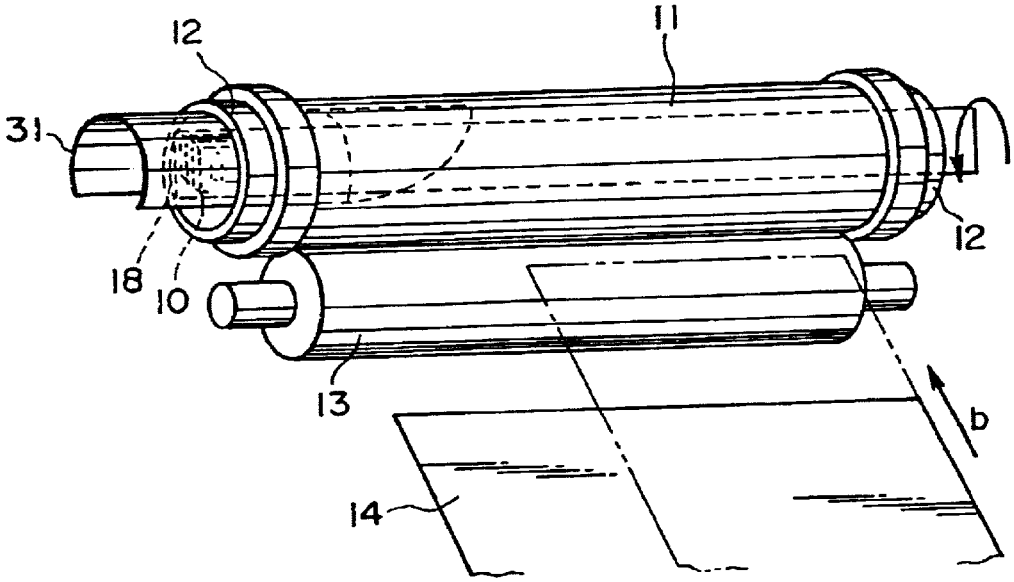
FIG. 1 is a schematic perspective view of a heating apparatus employing an inductive heat generating method, in the first embodiment of the present invention.

FIG. 1 is a perspective view of the heating apparatus employing an inductive heat generating method, in the first embodiment of the present invention.

Figure 2:
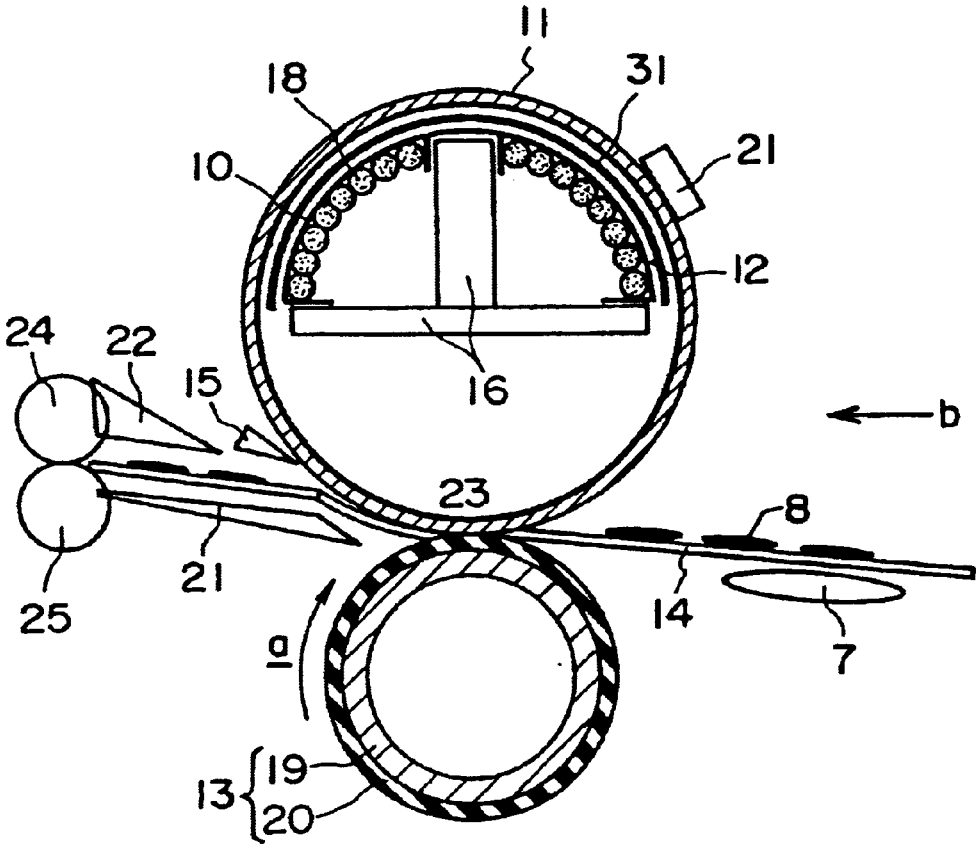
FIG. 2 is a schematic sectional view, perpendicular to the axial line of the heating apparatus, of the magnetic flux blocking plate of the heating apparatus employing an inductive heat generating method, in the first embodiment of the present invention.

FIG. 2 is a sectional view of the apparatus shown in FIG. 1.

The heating apparatus in this embodiment of the present invention is preferably used as the thermal fixing apparatus for an image forming apparatus.

Referring to FIGS. 1 and 2, a referential code 14 designates a recording medium 14, which is bearing an unfixed image formed of developer, and is being conveyed. The induction heating apparatus in FIGS. 1 and 2 is an apparatus for fusing the unfixed image formed on the recording medium 14 to the recording medium, by thermally melting the developer. The induction heating apparatus comprises; a coil unit 10 for generating a high frequency magnetic field; a heating roller 11 (equivalent to heating medium), which is heated by the coil unit 10, and is rotationally disposed along the conveyance path of the recording medium 14; and a holder 12, which is electrically insulative, and is stationarily positioned a predetermined distance away from the heating roller 11; and a pressure roller 13 which conveys the recording medium 14 while pressing the recording medium 14 against the heating roller 11. The pressure roller 13 is rotatable in the direction indicated by an arrow mark a in FIG. 2. It is rotated by the rotation of the heating roller 11.

The recording medium 14, bearing an unfixed toner image 8 which was transferred thereon, is conveyed from the direction indicated by an arrow mark b in the drawing and is fed over guide 7 into a nip portion 23, which will pinch the recording medium 14. Then, the recording medium 14 is conveyed through the nip portion 23 while being subjected to the heat frm the heated heating roller 11 and the pressure applied by the pressure roller 13. As a result, the unfixed toner image on the recording medium 14 is fixed to the recording medium 14, in other words, the unfixed toner image on the recoding medium 14 becomes a permanent toner image.

After being conveyed through the nip portion 23, the recording medium 14 is separated from the heating roller 11 starting from the leading end, by a separation claw 15 which is in contact with the peripheral surface of the heating roller 11. Then, it is conveyed in the leftward direction in FIG. 2. It is further conveyed and discharged into an unshown delivery tray by a guide 22 and sheet discharging rollers 24, 25.

The heating roller 11 is a hollow member with a thin wall, and is electrically conductive. It is provided with an electrically conductive layer formed of an electrically conductive magnetic material, for example, nickel, iron, stainless steel (SUS 430), or the like. The surface layer of the heating roller 11 is a coated heat resistant release layer formed of fluorinated resin. The thickness of the metallic layer of the heating roller 11 is in a range of 300 $\mu$m–1 mm.

In order to generate Joule heat by inducing electrical current (eddy current) in the electrically conductive layer of the heating roller 11, the coil unit 10, which generates high frequency magnetic field, is disposed within the hollow of the heating roller 11. This coil unit 10 is held within the holder 12. The holder 12 is nonrotational and is stationarily fixed to an unshown fixing unit frame.

The coil unit 10 has: a core 16 formed of magnetic material; and an induction coil 18 which generates the magnetic field for heating the heating roller 11 by inducing electrical current in the heating roller 11.

As for the material for the core 16, such material as ferrite, permalloy, Sendust, or the like, which is large in permeability and small in internal loss, is suitable. The coil unit 10 is disposed within the holder 12, being prevented from being exposed.

The holder 12 and separation claw 15 are formed of heat resistant and electrically insulative engineering plastic.

The pressure roller 13 comprises: a center shaft 19; and a silicone rubber layer 20 formed around the center shaft 19. The silicone rubber layer 20 is heat resistant, and its peripheral surface has a releasing property.

Above the heating roller 11, a temperature sensor 21 for detecting the temperature of the heating roller 11 is disposed in contact with the peripheral surface of the heating roller 11, opposing the induction coil 18 with the presence of the wall of the heating roller 11 between the heating roller 11 and induction coil 18. The temperature sensor 21 is a thermistor, for example, which detects the temperature of the heating roller 11, in response to which the electrical power to the induction coil 18 is controlled so that the temperature of the heating roller 11 becomes optimal.

Next, the movements and functions of the heating apparatus in this embodiment will be described.

The heating roller 11 has a magnetic metallic layer. Therefore, as high frequency electric current is flowed through the induction coil 18, high frequency electric current is induced in the magnetic metallic layer of the heating roller 11 by the magnetic field generated by the induction coil 18. As a result, the heating roller 11 is heated. An induction heating method is high in heat generation efficiency. Further, the heating roller 11 is given a thin wall, being therefore low in thermal capacity. Thus, as electric current is flowed through the induction coil 18, the temperature of the heating roller 11 rapidly increases.

The heating roller 11 is kept in contact with the pressure roller 13, with the application of a predetermined amount of pressure, and is rotated by an unshown driving force source, causing the pressure roller 13 to rotate therewith. The recording medium 14 which is bearing the transferred unfixed toner image is fed into the nip portion 23 between the heating roller 11 and pressure roller 13, and is conveyed through the nip portion 23 while being subjected to the heat from the heated heating roller 11 and the pressure applied by the pressure roller 13. As a result, the toner or the toner image are fixed to the recording medium 14.

Figure 3:
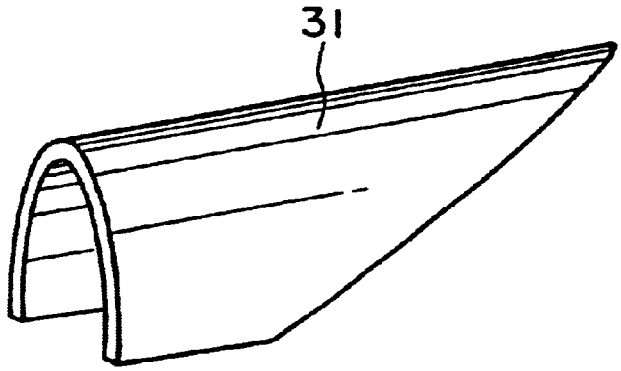
FIG. 3 is a schematic perspective view of the magnetic flux blocking plate of the heating apparatus employing an inductive heat generating method, in the first embodiment of the present invention.

The heating apparatus in this embodiment is provided with a magnetic flux blocking plate 31, the effective surface area of which is tapered in the axial direction of the heating roller 11 as shown in FIG. 3. Further, it is structured so that the holder 12 can be rotated by an unshown motor. Therefore, when a recording medium, the dimension of which in terms of the direction perpendicular to the recording medium conveyance direction is smaller than the maximum width of the recording medium path, is used, the width of the range of the heating roller 11 shielded by the magnetic flux blocking plate 31, in terms of the lengthwise direction of the heating roller 11, can be varied by rotating the holder 12, making it possible to control the heat distribution of the fixing roller 11, in spite of only a limited amount of space availability for the heating apparatus.

With the provision of the above described structural arrangement, the portion of the magnetic flux which is radiated from the induction coil 18 toward the portion of the heating roller 11 outside the recording medium path is blocked. Therefore, the problem that the temperature of the portion of the heating roller 11 outside the recording medium path becomes higher than the target temperature of the portion of the heating roller 11 corresponding to the recording medium path is prevented. On the other hand, when a larger recording medium is fed, the magnetic flux blocking plate 31 is moved out of the recording medium path of this larger recording medium by a driving motor (not shown). Thus, the heating roller 11 is uniformly heated by the magnetic flux from the induction coil 18.

With the employment of a magnetic flux blocking plate 31 such as the above described one, even if the heating roller 11 is of a thin wall type, it is possible to control the heat distribution of the heating roller 11, the temperature of which is increased with no relation to the size of a recording medium to be fed. Further, heat is not generated in the portion of the heating roller 11 other than the portion of the heating roller 11 necessary to be heated. Therefore, heat loss is small, contributing to energy conservation.

In other words, with the provision of the above described structural arrangement, it is possible to reduce the temperature increase across the portion of the heating roller 11 outside the recording medium path, preventing the temperature of the heating roller 11 from becoming nonuniform in terms of the lengthwise direction of the heating roller 11. As a result, it is possible to efficiently prevent the problems caused by the temperature increase across the portion of the heating roller 11 outside the recording medium path. More specifically, it is possible to prevent: the high temperature offset traceable to the nonuniformity in the fixing performance of the heating roller 11 which occurs as a large size recording medium is fed immediately after a small size recording medium is passed; the wrinkling, skewing, jamming, and/or the like, or recording medium, traceable to the nonuniformity in the temperature of the heating roller 11 which occurs also as a large size recording medium is fed immediately after a small size recording medium is passed; damage such as melting or deformation of the structural components of the heating apparatus which occurs as the temperature of the heating apparatus exceeds the maximum temperature which the components can withstand; and the like.

In this embodiment, the magnetic flux blocking plate 31 (equivalent to magnetic flux blocking means) for partially blocking the magnetic flux radiated from the induction coil toward the heating roller 11 is positioned between the heating roller 11 and induction coil 18 conforming to the shape of the outwardly facing surface of the holder 12, and also being enabled to be moved in the axial direction of the heating roller 11 by a magnetic flux blocking plate moving means so that the width of the range of the heating roller 11 heated by the induction current can be controlled. Incidentally, the thinner the wall of a heating medium, such as the heating roller 11, in other words, the more difficult for heat to conduct in the lengthwise direction of the heating medium, the more effectively the width of the range of the heating roller 11 heated by the induction current can be controlled.

The magnetic flux blocking plate 31 is desired to be formed of nonmagnetic metallic material such as copper, aluminum, silver, silver alloy, or the like, which is electrically conductive enough to allow induction current to flow through the magnetic flux blocking plate 31, is small in specific resistance, and the volumetric resistivity of which is no more than $5.0\times10^{-8}$ [ohm.cm].

The magnetic flux blocking plate 31 is shaped like an object formed by tapering a semicylinder in the its axial direction, as shown in the drawing. It covers mainly the top half of the induction coil 18. When a small size recording medium (contoured by double-dot chain line in FIG. 1) is passed, the magnetic flux blocking plate 31 is moved by the magnetic flux blocking plate moving means 40 to the position at which it covers the portion (contoured by double-dot chain line in FIG. 1) of the induction coil 18 corresponding to the portion of the heating roller 11 outside the recording medium path, in terms of the axial line of the heating roller 11. On the other hand, when a large size recording medium is passed, it is retracted in the axial direction of the heating roller 11 to a position at which it is completely outside the recording medium path.

In other words, the heating apparatus in this embodiment is structured so that the position of the magnetic flux blocking plate 31 can be varied in response to the position and width of the portion of the heating roller 11 corresponding to the position and width of the recording medium path of the recording medium being fed. Therefore, it is capable of dealing with various recording mediums different in the width in terms of the direction parallel to the axial direction of the heating roller 11. Further, in this embodiment, the information regarding the width of the recording medium path of the recording medium being fed is obtained by a recording medium size detecting means (unshown) of the recording medium feeding portion. However, the recording medium size information may be detected by placing, in alignment, a plurality of means (unshown) for detecting the temperatures of the heating roller 11, pressure roller 13, and the like, in the axial direction of the heating roller 11. The shape of the magnetic flux blocking plate 31 does not need to be limited to that of the above described tapered semicylinder; it may be a cylindrical.

Figure 4:
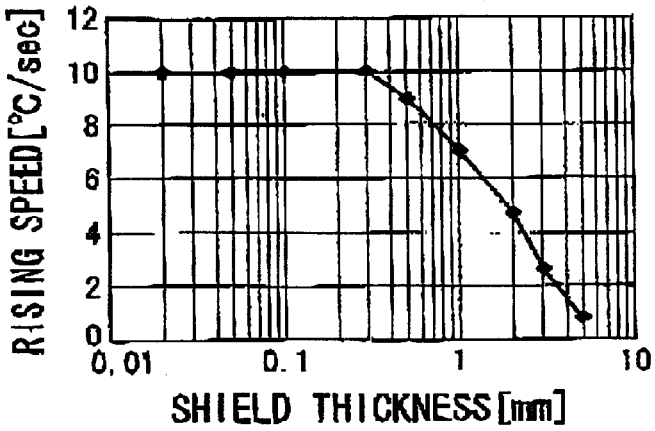
FIG. 4 is a graph showing the relationship between the thickness of the magnetic flux blocking plate and the startup speed of the heating apparatus, in the heating apparatus employing an inductive heat generating method, in the first embodiment of the present invention.
Figure 5:
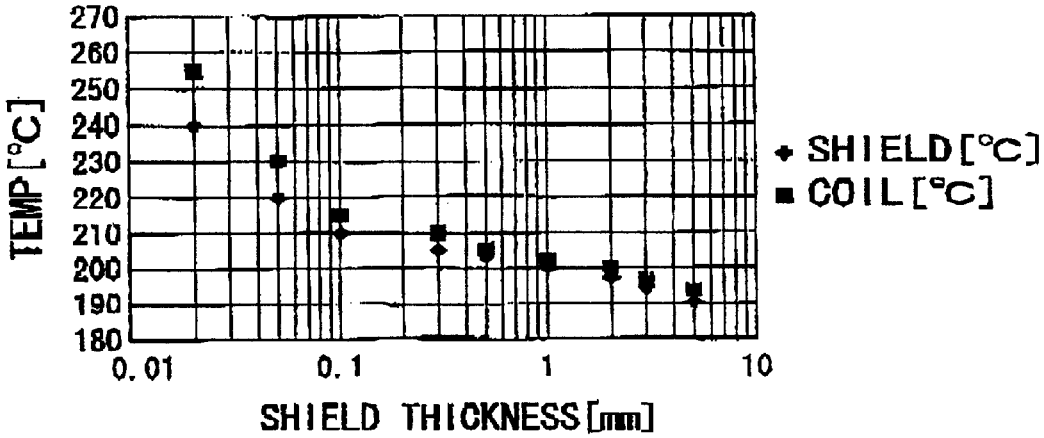
FIG. 5 is a graph showing the relationship among the thickness of the magnetic flux blocking plate, temperature of the magnetic flux blocking plate, and temperature of the coil, in the heating apparatus employing an inductive heat generating method, in the first embodiment of the present invention.

The relationship between the thickness of the magnetic flux blocking plate 31 and the startup time of the heating apparatus is shown in FIG. 4, and the relationship between the temperature of the magnetic flux blocking plate 31, and the temperature of the portion of the induction coil 18 covered by the magnetic flux blocking plate 31 is shown in FIG. 5.

Test conditions:

The fixing roller was 40 mm in diameter, had an iron core, was 0.5 mm in wall thickness, formed a nip having a width of 7 mm; an electrical power of 800 W was inputted; the target temperature was 180° C.: a plurality of A1R 80 g recording paper sheets were fed at a conveyance speed of 300 mm/sec to form 40 copies per minute; the magnetic flux blocking plate 31 was formed of aluminum: and the induction coil coating was formed of polyamide-imide.

In order to increase the fixing roller temperature from the room temperature (250 C.) to the fixing temperature (1600 C.), that is, the temperature at which fixing is possible, in approximately 30 seconds, the temperature of the fixing roller must be increased at a rate of 4.5° C./sec or greater:

$$(160-25)/30=4.5[^\circ\ \text{C./sec}].$$

Thus, it is evident from FIG. 4 that the thickness of the magnetic flux blocking plate must be no more than 2 mm.

Further, it is evident from FIG. 5 that when the thickness of the magnetic flux blocking plate is less than a certain value, the magnetic flux blocking plate itself generates heat, increasing the temperature of the portion of the coil which is in the adjacencies of the magnetic flux blocking plate. Since the highest temperature which the coating of the induction coil can withstand is 220° C., the thickness of the magnetic flux blocking plate must be no less than 0.1 mm. Therefore, it is reasonable to think that the thickness of the magnetic flux blocking plate should be set to a value within a range of 0.1 mm–2 mm.

The above described embodiment was not presented to limit the scope of the present invention; the present invention can be embodied in various forms. In other words, even through the induction heating apparatus in the above described embodiment employed a follow metallic roller as a heating medium, the application of the present invention is not limited to an induction heating apparatus employing a follow metallic roller. Obviously, the present invention is also applicable to an induction heating apparatus employing a heating roller having flexibility.

(Embodiment 2)

Next, the second embodiment of the present invention will be described with reference to the appended drawings. The members in this embodiment identical to those in the first embodiment are given the same referential codes as those used in the first embodiment, and their descriptions will be omitted.

Figure 6:
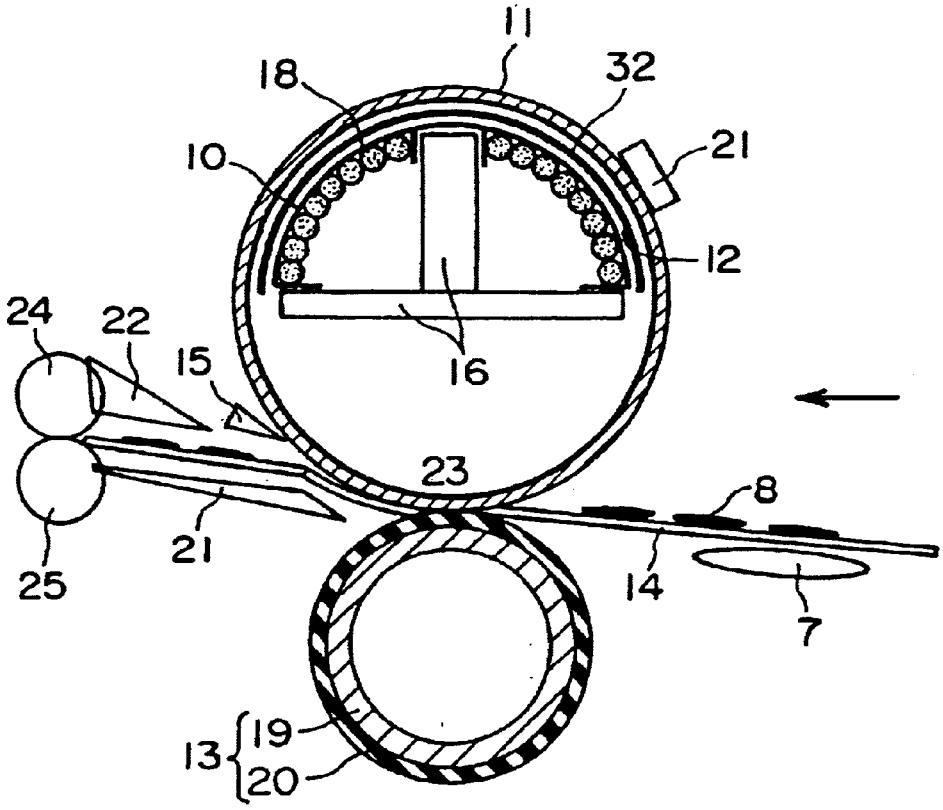
FIG. 6 is a sectional view, perpendicular to the axial line of the heating apparatus, of the heating apparatus employing an inductive heat generating method, in the second embodiment of the present invention.
Figure 7:
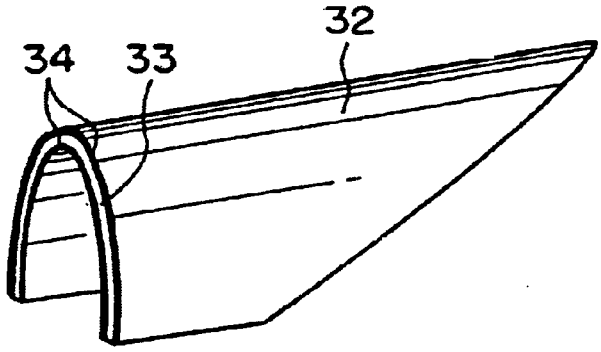
FIG. 7 is a schematic perspective view of the magnetic flux blocking plate of the heating apparatus employing on inductive heating generating method, in the second embodiment of the present invention.

FIG. 6 is a schematic vertical sectional view of the heating apparatus employing an inductive heating method, in the second embodiment of the present invention, and FIG. 7 is a perspective view of the magnetic flux blocking means employed by the heating apparatus shown in FIG. 6. A magnetic flux blocking plate 32 comprises a base layer 34, and two metallic surface layers which sandwich the base layer 34. In this embodiment, the metallic surface layers 33 are formed of silver, and have a thickness of 10 $\mu$m. The base layer 34 is formed of aluminum, and has a thickness of 200 $\mu$m.

The magnetic flux blocking plate 32 is formed by plating the aluminum base layer with silver. The metallic surface layers 33 are very thin, and therefore, they generate heat therein. However, they are formed of silver, that is, a material very low in electrical resistance. Therefore, the amount by which heat is generated in the metallic surface layers 33 is small.

Further, the heat generated in the surface layers 33 is dissipated into the aluminum base layer, being prevented from locally increasing the temperature of the magnetic flux blocking plate 32. If a magnetic flux blocking plate 32 having the above described thickness is formed of silver alone, the heat generation in the magnetic flux blocking plate 32 itself can be prevented, but the cost of the magnetic flux blocking plate 32 becomes rather high. In comparison, the structural arrangement in this embodiment makes it possible to provide a relatively inexpensive magnetic flux blocking plate 32 which does not generate heat in itself. In this case, a substance such as aluminum, silver, copper, or the like, which is low in electrical resistance, can be used as the material for the surface layers, and a substance such as aluminum, copper, stainless steel (SUT304), or the like, which is nonmagnetic metal, can be used as the material for the base layer.

When the metallic surface layer 33 is a 0.1 mm thick aluminum layer, heat is not generated in the surface layers. Therefore, the magnetic flux blocking plate 32 is required not to rob heat from the fixing roller 11 as a heating medium. Thus, in order to improve the thermal efficiency, the base layer 34 may be formed of material low in thermal conductivity. More specifically, it may be formed of heat resistant resin such as polyimide, liquid polymer, or polyamide-imide, or ceramic such as silicon carbide, silicon nitride, or alumina.

As described above, according to the present invention, the thickness of the magnetic flux blocking plate which makes it possible to control the heat distribution of a heating medium, the temperature of which is increased with no relation to the size of the recording medium to be passed through a heating apparatus, is limited. Therefore, the amount by which heat is generated by the magnetic flux blocking plate is minimized. Further, the thermal capacity of the fixing apparatus is reduced. Therefore, not only is the startup time is reduced, but also the thermal loss, contributing to energy conservation.

Further, the above described effects can be realized by giving the magnetic flux blocking plate a multilayer structure.

As a result, it becomes possible to reduce the amount by which the temperature or the portion of the heating medium outside the recording medium path of the recording medium increases, making therefore it possible to minimize the nonuniformity in the temperature of the heating medium in terms of the lengthwise direction of the heating medium. Therefore, it is possible to efficiently prevent the problems traceable to the temperature increase across the portion of the heating medium outside the recording medium path, for example, the high temperature offset traceable to the nonuniformity in the fixing performance of the heating roller 11 which occurs as a large size recording medium is fed immediately after a small size recording medium is passed: the wrinkling, skewing, jamming, and/or the like, of recording medium, traceable to the nonuniformity in the temperature of the heating roller 11 which occurs also as a large size recording medium is fed immediately after a small size recording medium is passed: the stress generated within the heating medium by the temperature difference between a given point of the heating medium and the others, and the resultant deterioration of the heating medium; the damage such as melting or deformation of the structural components of the heating apparatus which occurs as the temperature of the heating apparatus exceeds the maximum temperature which the component can withstand; and the like.

While the invention has been described with reference to the structures disclosed herein it is not confined to the details set forth and this application is intended to cover such modifications or changes as may come within the purposes of the improvements or the scope of the following claims.

What is claimed is:

1. An image fixing apparatus comprising:

magnetic field generating means for generating a magnetic flux;

a heating member generating heat by induction heating by the magnetic flux generated by said magnetic field generating means wherein said heating member has a metal layer having a thickness of 0.3–1 mm; and a blocking plate, disposed for movement between said magnetic field generating means and said heating member, for blocking the magnetic flux from said magnetic field generating means, wherein said blocking plate comprises an electroconductive member having a thickness of 0.1–2 mm.

2. An apparatus according to claim 1, wherein the electroconductive member has a volume resistivity of not more than $5.0\times10^{-8}$ ohm.cm.

3. An apparatus according to claim 1, wherein the electroconductive member is made of aluminum.

4. An apparatus according to claim 1, wherein the electroconductive member includes a plurality of electroconductive layers having different thermal conductivities.

5. An apparatus according to claim 1, wherein said heating member is contactable to a carrying member carrying an unfixed image.

6. An apparatus according to claim 1, further comprising temperature control means for maintaining said heating member at a predetermined fixing temperature, wherein a time period from start of electric energy supply to said magnetic field generating means to arrival of the temperature of said heating member at the fixing temperature is not more than 30 seconds.

* * * * *

UNITED STATES PATENT AND TRADEMARK OFFICE

CERTIFICATE OF CORRECTION

PATENT NO. : 6,687,481 B2
DATED : February 3, 2004
INVENTOR(S) : Osamu Watanabe et al.

It is certified that error appears in the above-identified patent and that said Letters Patent is hereby corrected as shown below:

Column 2,
Line 9, “or” should read -- of --.
Line 10, “then” should read -- than --.
Line 27, “passed. The” should read -- passed, the --.

Column 3,
Line 63, “interior” should read -- inferior --.

Column 4,
Line 66, “on” should read -- an --.

Column 5,
Line 24, “comprises;” should read -- comprises: --.
Line 42, “frm” should read -- from. --.
Line 45, “medium 14,” should read -- medium 14; --.

Column 6,
Line 53, “or” should read -- of --.
Line 54, “are” should read -- is --.

Column 7,
Line 40, “or” should read -- of --.
Line 53, “coil 18” should read -- coil 18, --.

Column 8,
Line 6, “the” should be deleted.
Line 40, “a” should be deleted.
Line 52, “180º C.:” should read -- 180º C.; --; and “A1R 80g” should read -- A4R 80g --.
Line 55, “aluminum:” should read -- aluminum; --.
Line 58, “(250 C.)” should read -- (250º C.) --; and “(1600” should read -- (1600º --.

Column 9,
Line 13, “through” should read -- though --.
Lines 14 and 17, “follow” should read -- hollow --.
Line 59, “(SUT304),” should read -- (SUS304), --.

UNITED STATES PATENT AND TRADEMARK OFFICE

CERTIFICATE OF CORRECTION

PATENT NO. : 6,687,481 B2
DATED : February 3, 2004
INVENTOR(S) : Osamu Watanabe et al.

It is certified that error appears in the above-identified patent and that said Letters Patent is hereby corrected as shown below:

Column 10,
Line 13, “is” should be deleted.
Line 19, “or” should read -- of --.
Line 30, “passed:” should read -- passed; --.
Line 35, “passed.” should read -- passed; --.

Signed and Sealed this

Fifteenth Day of June, 2004

JON W. DUDAS
*Acting Director of the United States Patent and Trademark Office*